United States Patent [19]

Boulanger et al.

[11] 4,446,450

[45] May 1, 1984

[54] THERMOSTAT DEVICE HAVING IMPROVED MOUNTING MEANS

[75] Inventors: Henry J. Boulanger, Nicolasville, Ky.; Andrew C. McGuirk, North Attleboro; William J. LaPlante, Rehoboth, both of Mass.

[73] Assignee: Texas Instruments Incorporated, Dallas, Tex.

[21] Appl. No.: 449,942

[22] Filed: Dec. 15, 1982

[51] Int. Cl.[3] ..... H01H 37/04

[52] U.S. Cl. ..... 337/380; 337/272; 337/381

[58] Field of Search ..... 337/343, 365, 372, 380, 337/381

[56] References Cited

U.S. PATENT DOCUMENTS

| | | | |
|---|---|---|---|
| 3,581,263 | 5/1971 | Moro | 337/380 |
| 3,735,310 | 5/1973 | Kochanski | 337/380 X |
| 4,268,812 | 5/1981 | Satterlee | 337/372 X |
| 4,297,668 | 10/1981 | Place | 337/380 X |
| 4,349,806 | 9/1982 | Boulanger . | |

*Primary Examiner*—George Harris

*Attorney, Agent, or Firm*—James P. McAndrews; John A. Haug; Melvin Sharp

[57] ABSTRACT

A thermostat device comprises a thermostat unit having a surface which faces in a first direction and which is preferably disposed in thermally-coupled heat-transfer relation to an object whose temperature is to be monitored so that the thermostat unit is promptly responsive to an object temperature, the unit also having other surfaces which face in an opposite direction. A metal mounting bracket plate has a base portion, has a stud secured to the base portion to extend in one direction from the base for securing the plate to the object to be monitored in thermally-coupled heat-transfer relation to the object, and has integral spring portions upstanding from respective opposite ends of the base portion of the plate. The spring portions have openings fitted over respective portions of the thermostat unit so that parts of the spring portions around the margins of the openings engage said other unit surfaces for detachably attaching the bracket plate to the unit and for resiliently biasing the first unit surface against the base portion of the bracket plate to be thermally-coupled in heat-transfer relation to the object to be monitored.

3 Claims, 3 Drawing Figures

THERMOSTAT DEVICE HAVING IMPROVED MOUNTING MEANS

BACKGROUND OF THE INVENTION

The field of this invention is that of thermostat devices and the invention relates more particularly to thermostat devices adapted for widespread application to monitor the temperatures of various different objects and equipments.

When thermostat devices are manufactured by automated manufacturing techniques or the like to achieve low unit costs so that the units are adapted for widespread application to monitor the temperatures of different types of objects and equipments, it is sometimes found that difficulties are encountered in testing the devices after manufacture, in shipping the devices to customers, and in mounting the devices on objects or equipments whose temperatures are to be monitored. That is, the handling of the devices for test purposes is found to be cumbersome and the devices are somewhat bulky to package and ship in quantity so that test and shipping costs tend to represent an excessive proportion of the otherwise low thermostat unit costs. Most important, customer mounting of the devices on objects to be monitored is also somewhat inconvenient and is frequently found to be less than fully satisfactory so that thermal response characteristics of the devices are slower than desired and frequently vary from device to device more than is believed necessary.

SUMMARY OF THE INVENTION

It is an object of this invention to provide a novel and improved thermostat device; to provide such a device having improved mounting means; to provide such a device which is adapted to be tested, shipped and mounted on an object whose temperature is to be monitored with improved economy and convenience; to provide such a device which is readily mounted on the object to be monitored to achieve fast and consistent thermal response characteristics; and to provide such a device which is of simple, rugged and inexpensive construction.

Briefly described, the novel and improved thermostat device of this invention includes a thermostat unit having a first surface which faces in a first direction and which comprises the preferred surface of the unit to be disposed in thermally-coupled heat-transfer relation to an object whose temperature is to be monitored, the thermostat unit also having other surfaces which face in an opposite direction. A metal mounting bracket for the thermostat unit then comprises a plate having an integral base portion, having a stud secured to the base portion of the plate to extend in one direction from the base portion for securing the plate to the object to be monitored in thermally-coupled heat-transfer relation to the object, and having integral spring portions which extend in an opposite direction from the base portion. The spring portions have openings therein fitted over respective portions of the thermostat unit so that parts of the springs around the margins of the openings resiliently engage said other surfaces of the thermostat unit for attaching the bracket plate to the thermostat unit and for resiliently biasing the first surface of the thermostat unit against the base portion of the plate to be thermally-coupled in heat-transfer relation to the object to be monitored. In a preferred embodiment, the thermostat unit includes a housing having an integral mounting flange and having thermally-responsive means mounted in the unit so that when the spring portions of the bracket plate are arranged to fit over that mounting flange for mounting the unit the unit is mounted without altering the thermal response characteristics of the unit. Preferably, where the thermostat unit has terminals extending therefrom, the thermostat unit has flats formed thereon and said spring portions of the bracket plate engage said flats for retaining the unit terminals in a selected orientation relative to the object.

In that arrangement, the mounting brackets are of low cost construction, the thermostat units are adapted to be tested and shipped separate from the bracket mounting plates for achieving greater convenience in testing using a standard mounting bracket or in other conventional manner and for achieving easier and lower cost packaging and shipping of the device components, and the thermostat device are more easily and reliably mounted on objects to be monitored for achieving more consistant thermal response characteristics.

DESCRIPTION OF THE DRAWINGS

Other objects, advantages and details of the novel and improved thermostat device of this invention appear in the following detailed description of preferred embodiments of the invention, the detailed description referring to the drawings in which.

DESCRIPTION OF PREFERRED EMBODIMENTS

Figure 3:
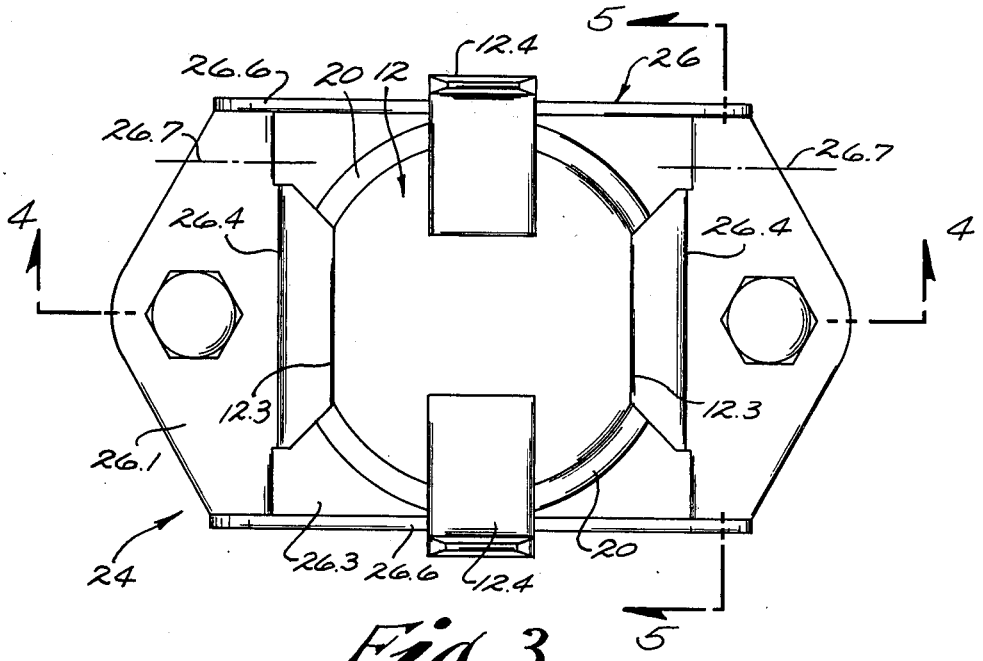
FIG. 3 is a isometric view of the thermostat device of this invention.
Figure 4:
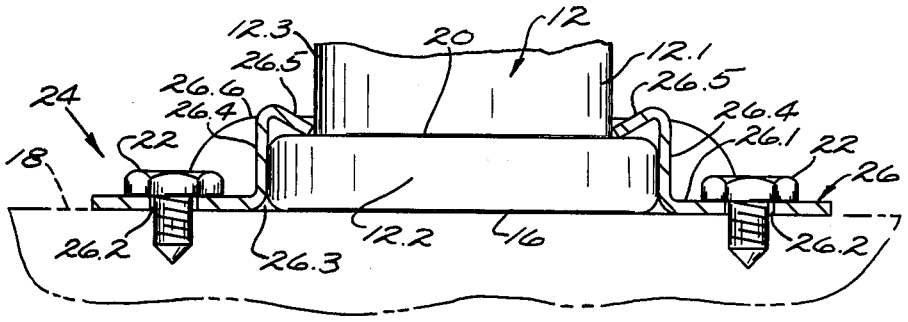
Figure 5:
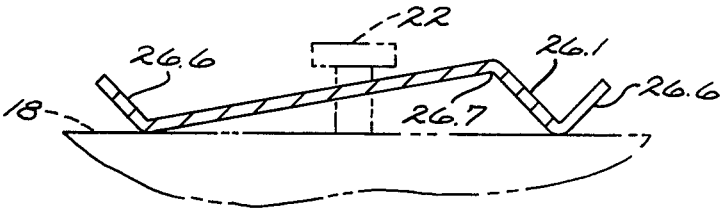

Referring to the drawings, 10 in FIG. 3 indicates the novel and improved thermostat device of this invention which is shown to include a thermostat unit 12 and mounting bracket means 14.

In accordance with this invention, the thermostat unit 12 has a first surface 16 which faces in a first direction and which is preferably disposed in thermally-coupled heat-transfer relation to an object 18 whose temperature is to be monitored. The thermostat unit also has second surface portions 20 which face in an opposite direction. Preferably the thermostat unit 12 is of a conventional construction as shown in U.S. Pat. No. 4,349,806, the disclosure of which is herein incorporated by this reference. In that known device, the thermostat unit comprises a generally cylindrical, cup-shaped housing 12.1 an open end and having an integral flange 12.2 formed around the rim of the open end of the cup-shaped housing enclosing electrical switch means diagrammatically indicated at 12.3. A metal cap 12.4 is secured over the open end of the cup-shaped housing 12.1 by swaging, rolling or staking over the flange 12.2 for forming said first surface 16 at one end of the unit housing and forming the second surface portions 20 extending around the circumference of the unit. A thermally-responsive bimetallic snap-acting dished disc member 12.5 (illustrated as a single layer for clarity) is disposed within that housing adjacent to the metal cap 12.4 to be responsive to selected changes in temperature to snap to an inverted dished configuration for moving the switch means in the unit between open and closed circuit positions and the like in conventional manner and, accordingly the first surface 16 of the device is preferably disposed in thermally-coupled heat-transfer relation to the object 18 whose temperature is to be monitored so that the thermostat unit is most promptly and reliably responsive to changes in object temperature. Preferably flats 12.6 are formed on opposite sides of the cylindrical housing 12.1 and preferably terminal means 12.7 extend from the thermostat unit for connecting the noted electrical switch means in an electrical circuit as will be understood. As a thermostat unit preferred for use in this invention has been fully described in the noted patent, it is not further described herein and it will be understood that any corresponding thermostat unit having characteristics as noted above are adapted to be used within the scope of this invention.

Figure 1:
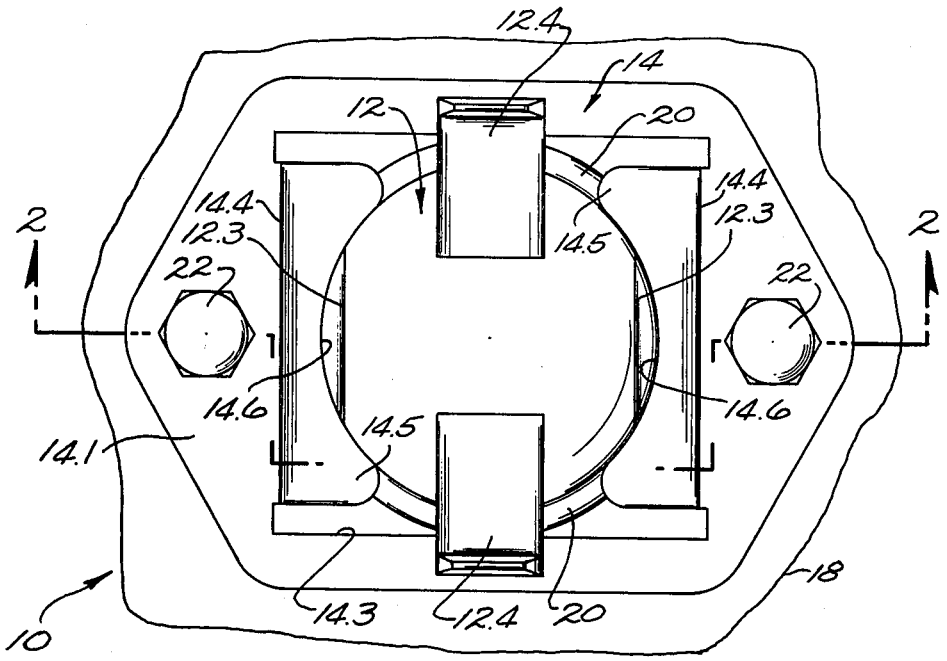
FIG. 1 is a isometric view of the mounting bracket used in the thermostat device of this invention.
Figure 2:
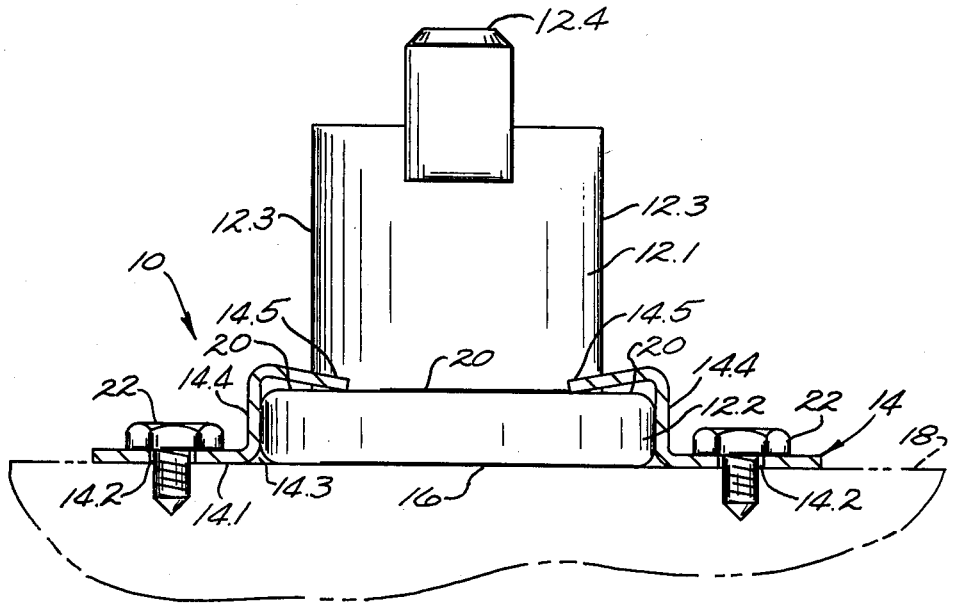
FIG. 2 is a section view along line 2—2 of FIG. 1.

In accordance with this invention, the mounting bracket means 14 comprises a metal plate 22 having a base portion 22.1 which extends in a plane and which has a bore 22.2 formed therein. Preferably the plate 22 is formed of low carbon steel or aluminum or the like having a stiff resilence, but the plate is also formed of other materials such as stainless steel or the like within the scope of this invention. A stud 28 is secured to the base portion of the plate to extend in one direction from the bottom of the base portion to be threadedly engaged or the like with the object 18 to be monitored for securing the plate in thermally-coupled heat-transfer relation to the object as will be understood. Preferably for example, the stud 28 has a head 28.1 with projections 28.2 spaced there around and the stud head is force-fitted and/or brazed or welded into the plate bore 22.2 for securely attaching the stud to the plate. As shown in FIG. 2, the head of the stud is preferably flush with the base portion of the plate and preferably does not extend above the surface of the plate.

In accordance with this invention, the bracket plate further includes integral spring portions 22.3 which extend from the base portion of the plate in a direction generally opposite to the direction of extension of the stud 28. Each of the spring portions of the bracket plate has an opening 22.4 therein and those openings are fitted over portions of the thermostat unit 12 at opposite sides of the unit so that parts of the spring portions at margins of the openings as indicated at 22.5 engage the second surfaces 20 of the thermostat unit. Typically, the spring portions are resiliently spread apart to receive the noted portions of the thermostat unit within the spring openings and, if desired, the spring portions of the bracket plate are then plastically deformed as may be desired for more securely fitting over the second surface portions 20 of the thermostat unit. In that way, the spring portions of the bracket attach the bracket plate to the unit and resiliently bias the noted surface 16 of the thermostat unit against the base portion of the plate to dispose the surface 16 in thermally-coupled heat-transfer relation to the object 18 whose temperature is to be monitored. Preferably as shown in FIGS. 2 and 3, the spring portions 22.3 of the bracket fit over the integral mounting flange 12.2 of the unit housing for holding the unit securely against the bracket plate without tending to stress the plate 12.4 or the snap-acting disc 12.5 in a way which might change the thermal response characteristics of the unit 12 during mounting of the unit. Preferably as shown, the flats 12.6 formed in the cylindrical sides of the thermostat unit provide sections of the surfaces 20 of substantial width to be securely engaged by the spring parts 22.3 and the spring parts also engage the flats to prevent rotation of the thermostat unit, thereby to retain the terminal means 12.7 of the unit in a selected orientation relative to the object 18. In that way, the bracket means 14 is of simple, low cost construction; the thermostat units are adapted to be easily tested and shipped separate from the bracket mounting plates for achieving convenience in testing and easier and less bulky packaging for shipping; and the thermostat devices are more easily and reliably mounted on objects to be monitored to achieve consistent thermal response characteristics. It should be understood that although particular embodiments of the invention have been described by way of illustrating the invention, this invention includes all modifications and equivalents thereof falling within the scope of the appended claims.

We claim:

1. A thermostat device comprising a thermostat unit and bracket means for mounting the unit on an object whose temperature is to be monitored, characterized in that the thermostat unit has a generally cylindrical configuration, has a first surface at one end of the unit to be disposed in thermally-coupled heat-transfer relation to said object, and has a second surface extending around the circumference of the unit facing in an opposite direction, and in that the bracket means comprises a plate having a base portion extending in a plane, has stud means secured to said base portion to extend in one direction from the base portion for securing the base portion in thermally-coupled heat-transfer relation to said object, and has a pair of integral spring portions extending in an opposite direction from respective opposite sides of the base portion, the spring portions each having an opening therein fitted over a portion of the thermostat unit between said first and second surface portion and having a marginal part of said opening engaging a second surface portion of the unit for attaching the bracket means to the thermostat unit and for resiliently biasing said first thermostat unit surface against said base portion to be disposed in thermally-coupled heat-transfer relation to said object.

2. A thermostat device as set forth in claim 1 further characterized in that the thermostat unit has terminals extending therefrom and has flat means formed on the sides of said cylindrical unit configuration, and said integral spring portions are arranged to engage said flats to retain said terminal means in a selected orientation relative to the object.

3. A thermostat device as set forth in claim 2 further characterized in that the thermostat unit comprises a cup-shaped housing having an open end and having an integral flange around said open end, switch means disposed in the housing to be movable between circuit positions, thermally responsive means disposed in the open housing end for moving the switch means between said circuit positions in response to related changes in temperature, and a metal cap which extends over the open housing end to form said first surface of the thermostat unit and which is formed over said flange to provide said second unit surface, and in that said spring portions of the bracket plate fit over said integral housing flange for mounting the unit on the plate without altering the thermal response characteristics of the unit during unit mounting.

* * * * *